US005445114A

United States Patent [19]

Walker

[11] Patent Number: 5,445,114

[45] Date of Patent: Aug. 29, 1995

[54] TRAINING HARNESS FOR USE WHEN PRACTICING ROCK CLIMBING AND SPORT CLIMBING

[76] Inventor: Douglas M. Walker, 1289 E. 300 N., Logan, Utah 84321

[21] Appl. No.: 164,560

[22] Filed: Dec. 10, 1993

[51] Int. Cl.[6] ..... A63B 21/18; A63B 21/26

[52] U.S. Cl. ..... 119/857; 182/6; 482/105

[58] Field of Search ..... 119/712, 726, 857; 482/74, 105; 182/3, 6; 244/151 R

[56] References Cited

U.S. PATENT DOCUMENTS

| | | | |
|---|---|---|---|
| 3,424,134 | 1/1969 | Rosenblum | 182/3 |
| 3,735,598 | 5/1973 | Oeland | 482/105 |
| 4,197,816 | 5/1980 | Lusch | 182/6 |
| 5,076,575 | 12/1991 | Eylander | 482/105 |
| 5,144,694 | 9/1992 | Conrad Da oud | 482/105 |
| 5,145,027 | 9/1992 | Petzl et al. | 182/6 |

*Primary Examiner*—John G. Weiss
*Attorney, Agent, or Firm*—Terry M. Crellin

[57] ABSTRACT

A training harness for use by a sport climber in practicing sport climbing is disclosed. The harness comprises a waist encircling member and two leg encircling portions. Straps connect the leg encircling portions to the waist encircling member. At least one compartment or receptacle is formed integrally in the waist member, and a thin sheet of heavy material is removably received in each of the compartments or receptacles in the waist member. At least one compartment or receptacle is formed integrally in each of the leg encircling portions, and a thin sheet of heavy material is removably received in each of the compartments or receptacles in the leg encircling portions.

10 Claims, 2 Drawing Sheets

TRAINING HARNESS FOR USE WHEN PRACTICING ROCK CLIMBING AND SPORT CLIMBING

BACKGROUND OF THE INVENTION

1. Field of the Invention

The present invention relates to harnesses used by sports climbers. In particular, the present invention relates to training harnesses to be used when practicing sport climbing, wherein relatively thin sheets of heavy material can be inserted in receptacles in the harness to add apparent weight to the user of the harness as he or she is practicing.

2. State of the Art

Safety harnesses are used by climbers when they are climbing. Such harnesses are used during practice in rock gyms as well as when actually sport climbing. Heretofore, there has been no suggestion of providing supplemental weight to the harnesses. It would be highly advantageous to have means of adding weight to the harness while the climber is practicing climbing. By adding supplemental weight, the climber practices under increased loads on various muscles that are used in climbing. These muscles develop strength and toning in accordance with the exercise that they undergo. Increasing weight during practice will develop increased strength and toning of the muscles used in climbing. In addition, when the climber participates in actual sports climbing, weight is not, of course, added to the climber's harness, and the climber has the apparent feeling of weighing less than he or she actually weighs.

3. Objectives

A principal objective of the invention is to provide a novel, training harness to be used by sport climbers when practicing sport climbing.

A particular objective of the present invention is to provide such a training harness that has compartments or receptacles in the waist encircling portion of the harness for receiving relatively thin sheets of a heavy material.

Another objective of the present invention is to provide a training harness having compartments or receptacles in the leg encircling portions of the harness for receiving relatively thin sheets of a heavy material.

BRIEF DESCRIPTION OF THE INVENTION

The above objectives are achieved in accordance with the present invention by providing a novel, unique training harness for use by sport climbers while practicing sport climbing. Sport climbers must wear a safety harness while climbing and practicing. The harness comprises a waist encircling portion having a relatively broad, elongate, fabric waist member that extends from a first end at one front side of the wearer around the wearer's back to a second end at the front side of the wearer. A cinch strap connects the first and second ends of the waist member at the front of the wearer. The harness further has two leg encircling portions, and straps connect the individual leg encircling portions to the waist encircling portion.

In accordance with the present invention, an improvement is provided in such a harness to convert the harness to a training harness that is used during practicing sport climbing. The improvement comprises providing at least one compartment or receptacle in the waist member of the harness. There is further provided at least one thin sheet of a heavy material that can be removably received in the compartment or receptacle such that the sheet of heavy material is held snugly against the body of the person wearing the harness.

When such a sheet of heavy material is inserted into the compartment or receptacle of the training harness of the present invention, the wearer experiences an increase in apparent weight. This increase in weight has two principal benefits. First, the person wearing the harness practices under increased weight loads on the various muscles that are used in climbing. The muscles respond to such exercise to develop increased strength and improved toning. Second, the person wearing the harness becomes accustomed to the increased weight provided by the sheet of heavy material contained in the compartment or receptacle of the training harness. Then, when the person removes the thin sheets from the compartments or receptacles or puts on a standard harness for participation in actual sport climbing, the person has the perception of losing weight and being lighter. The person's muscles have developed increased strength and toning, and the person also experiences an apparent loss of weight. This allows the person to perform at a maximum efficiency when participating in actual sport climbing.

It is preferable to provide at least two compartments or receptacles in the waist member of the training harness, and at least one thin sheet of heavy material is provided for each of the compartments or receptacles. Generally three, four, five or more compartments or receptacles can be provided in the waist member of the training harness. Preferably, the compartments or receptacles are sewn integrally in the waist member and resemble pockets in a shirt. At least one thin sheet of heavy material can be provided for each of the compartments or receptacles in the waist member of the training harness.

The training harness of the present invention can also have compartments or receptacles in each of the leg encircling portions of the harness to receive thin sheets of heavy material in a manner similar to the compartments or receptacles in the waist member of the harness. In a manner similar to the waist member of the training harness, each leg encircling member of the harness can be provided with two, three, four or more compartments or receptacles, and at least one thin sheet of heavy material is provided for each of the compartments or receptacles in the leg encircling portions of the training harness.

Additional objects and features of the invention will become apparent from the following detailed description, taken together with the accompanying drawings.

THE DRAWINGS

Preferred embodiments of the present invention representing the best mode presently contemplated of carrying out the invention are illustrated in the accompanying drawings in which.

DETAILED DESCRIPTION OF THE ILLUSTRATED EMBODIMENT

Figure 4:
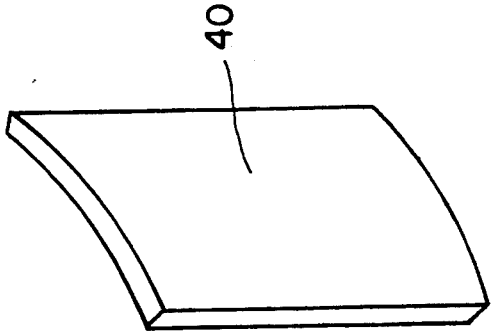
FIG. 4 is a pictorial representation of a thin sheet of heavy material for use with the training harness of the present invention.

Referring now to the drawings, there is shown one preferred embodiment of a training harness in accordance with the present invention. The training harness is to be used in practicing sport climbing and comprises the following structure that is well known and widely used in safety harnesses used in actual sports climbing. Such a harness includes a waist encircling portion formed from a relatively broad waist member 12. The waist member 12 is commonly formed by two elongate pieces of cloth 14 and 16 that are sewn face-to-face with each other so as to lie in side-by-side relationship as shown in the drawings. The piece of cloth 14 that faces the waist of the user when the harness is being worn can be made of a soft, felt-like material, with the outer piece of cloth 16 being made of a strong, denim or broadcloth material. The waist member 12 is elongate so that it can extend from a first end at one front side of the wearer 20 around the wearer's back to a second end at the other front side of the wearer. A cinch belt 22 connects the first and second ends of the waist member 12 at the front of the wearer. The waist member 12 generally has a width of from about 4 to 7 inches. The training harness will also have two leg encircling portions 24 and straps 26 and 28 that connect the leg encircling portions 24 to the waist member 12 and cinch belt 22, respectively, of the waist encircling member.

Figure 1:
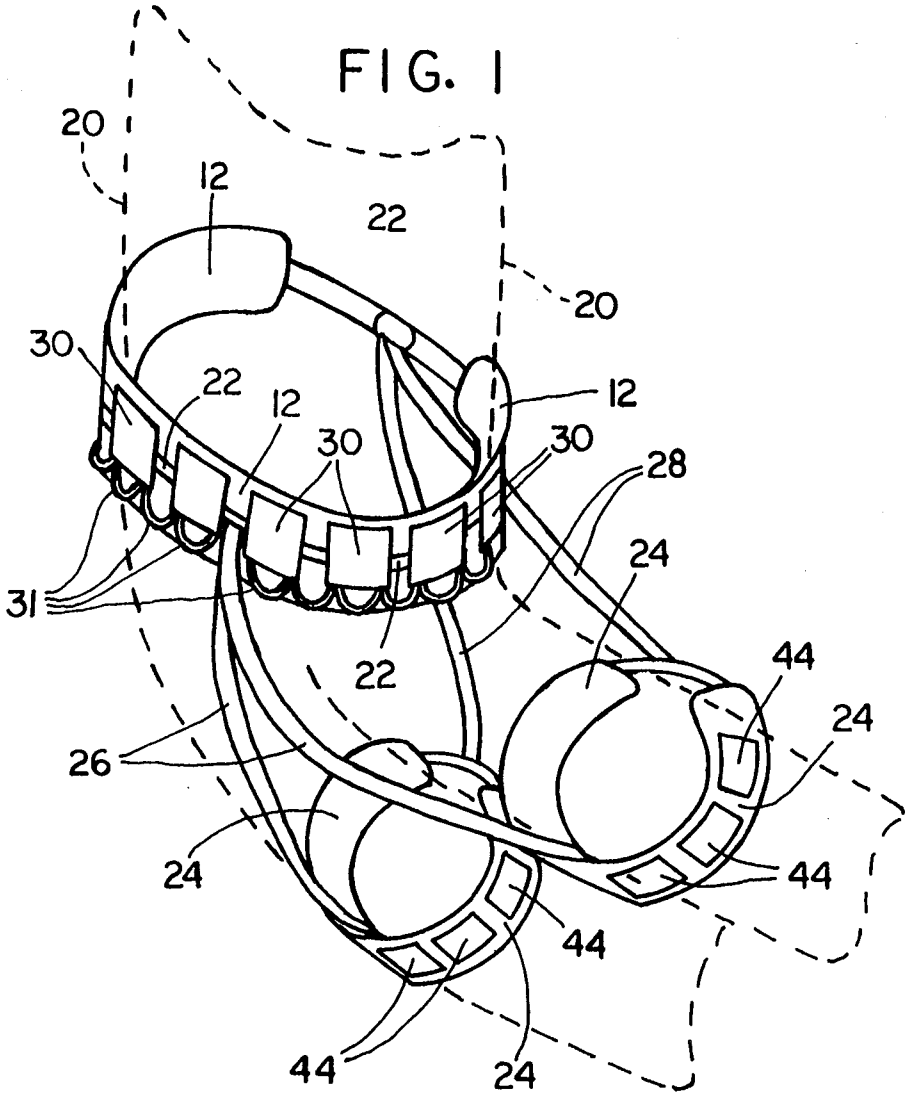
FIG. 1 is a pictorial representation of a training harness in accordance with the present invention showing the training harness as it would be worn about the torso of a person, with the torso of the person being shown by dashed, phantom lines.
Figure 2:
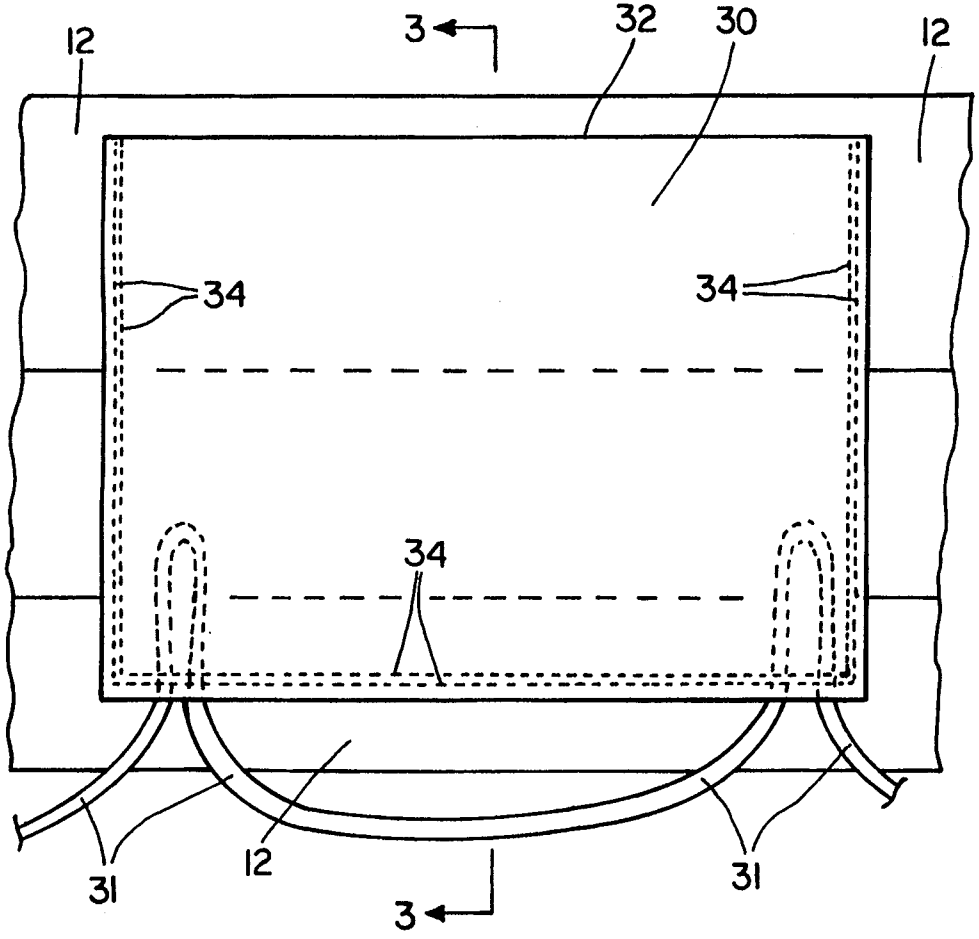
FIG. 2 is a partial elevation view of a portion of the training harness showing a pocket sewn in the training harness that is adapted to receive a thin sheet of heavy material.

As illustrated, the cinch belt 22 is securely sewn to the waist member 12 and extends completely around the waist member 12. This belt 22 is formed of strong belt material such as used in making seat belts for motor vehicles. As can be seen, the cinch belt 22 encircles the waist of the wearer and provides the fundamental strength for the harness. It is common to securely sew the cinch belt 22 to the waist member 12 at spaced apart locations along the length of the waist member 12. Further, as shown in FIGS. 1 and 2, loops 31 of a strong cord material are sewn around the bottom of the cinch belt 22 that extends along the waist member 12.

The leg encircling portions 24 have the same general construction as described previously with respect to the waist member 12, i.e., two pieces of elongate cloth sewn face-to-face so as to lie side-by-side. The leg encircling portions 24 extend around the legs of the wearer, and the ends of the leg encircling portions 24 are joined at the front of the legs of the wearer. Straps 26 extend from the mid-portion of the waist member 12 at the back of the waist of the wearer to the respective mid-portions of the leg encircling portions 24 at the back of the legs of the wearer. Straps 28 extend from the cinch belt 22 at the front of the wearer to the joinder of the leg encircling portions 24 at the front of the legs of the wearer.

A safety harness such as described in the previous three paragraphs is well known in the art, and the present invention pertains to an improvement in such safety harnesses. In accordance with the present invention, the safety harness as previously described is improved so as to provide an advantageous training harness to be used by a sport climber while practicing the art of sport climbing. Sport climbing has become very popular, and gyms, sometimes called rock gyms, have become numerous. These gyms provide training facilities that closely resemble natural sport climbing environments. These gyms make it possible for the sport climber to practice, and the training harnesses of the present invention are designed to be used by the sport climber while practicing.

To provide an improved training harness to be used in practicing sport climbing, at least one compartment or receptacle 30 is formed integrally with the waist member 12 of an otherwise conventional safety harness as described previously. Generally, at least two such compartments or receptacles 30 are formed on the waist member 12, and preferably a plurality of such compartments or receptacles 30, such as five, six or more, are provided, with the compartments or receptacles 30 being spaced generally uniformly along the length of the waist member 12. The compartments or receptacles 30 are preferably pockets similar to pockets in a shirt that are sewn on the outer perimeter side of the waist member 12.

Figure 3:
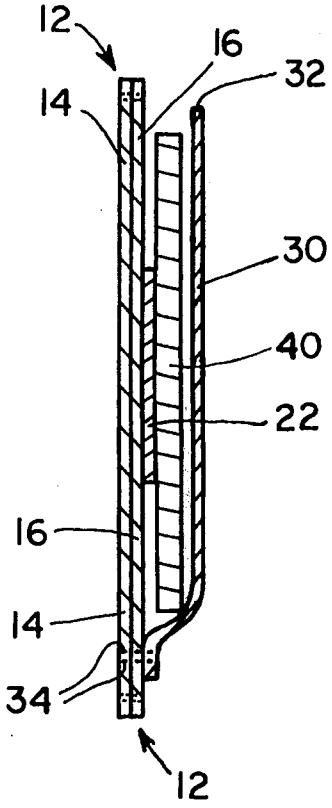
FIG. 3 is a cross section taken along line 3—3 of FIG. 2, with a thin sheet of heavy material being shown in place in the pocket.

As best shown in FIGS. 2 and 3, each compartment or receptacle 30 in the waist member 12 is formed by a piece of cloth that is sewn on the outer perimeter side of the waist member 12. The cloth is sewn by a double row of stitching 34 to the outer side of the waist member 12 along the opposite side edges and the bottom edge. The top edge 32 of the cloth is not sewn so as to be open similar to a pocket on a shirt. A thin sheet 40 of heavy material (FIGS. 3 and 4) is adapted to be received in the compartment or receptacle 30 formed by the piece of cloth sewn to the waist member 12. The thin sheet 40 of heavy material is removably received in the compartment or receptacle 30 through the open, unsewn top of the piece of cloth that is sewn along its other edges to the outer side of the waist member 12.

The thin sheet 40 of heavy material is preferably made of a soft, malleable, lead-containing metal. The thin sheet 40 can preferably be bent and easily curved to fit the curvature of the respective compartments or receptacles 30 in the waist member 12 to be held snugly against the torso of the wearer of the harness. A plurality of thin sheets 40 can be provided so that there is at least one available for each of the compartments or receptacles 30 in the waist member 12. For added weight, two or three sheets 40 can be provided for each of the compartments or receptacles 30 in the waist member 12.

In the preferred embodiment of the invention as illustrated in the drawings, at least one compartment or receptacle 44 is formed integrally with each of the leg encircling portions 24 of the harness, and at least one thin sheet 40 is made available for each compartment or receptacle 44 in the leg encircling portions 24 of the harness. Generally, at least two such compartments or receptacles 44 are formed in each of the leg encircling portions 24, and preferably, a plurality of such compartments or receptacles 44, such as three, four or five, are provided, with the compartments or receptacles 44 being generally uniformly spaced along the length of each of the leg encircling portions 24. The compartments or receptacles 44 are preferably pockets that are sewn on the outer perimeter side of the leg encircling portions 24 in a manner similar to the sewing of the compartments or receptacles 30 on the waist member 12 as discussed previously. The thin sheets 40 of heavy material for insertion into the compartments or receptacles 44 of the leg encircling portions 24 are identical to the thin sheets 40 used with the compartments or receptacles 44 of the waist member 12.

Although a preferred embodiment of an improved training harness of the present invention has been illustrated and described, it is to be understood that the present disclosure is made by way of example and that various other embodiments are possible without departing from the subject matter coming within the scope of the following claims, which subject matter is regarded as the invention.

I claim:

1. A training harness to be used by a sport climber in practicing sport climbing, said harness comprising a waist encircling portion having a relatively broad, elongate, fabric, waist member that extends from a first end at a front of the wearer around the wearer's back to a second end spaced from said first end at the front of the wearer;

a cinch strap connecting the first and second ends of said waist member at the front of the wearer;

two leg encircling portions;

straps connecting the leg encircling portions to the waist encircling portion;

at least one compartment or receptacle formed integrally with the waist member; and at least one thin sheet of a heavy material that can be removably received in said compartment or receptacle to be held snugly against the wearer of the harness.

2. A training harness in accordance with claim 1 wherein at least two compartments or receptacles are formed integrally with said waist member, and at least one thin sheet of heavy material is provided for each of said compartments or receptacles.

3. A training harness in accordance with claim 2 wherein said compartments or receptacles are pockets sewn on an outer perimeter side of the waist member.

4. A training harness in accordance with claim 1 wherein a plurality of said compartments or receptacles are formed integrally with the waist member, said compartments or receptacles are spaced generally uniformly along the length of the waist member, and at least one thin sheet of heavy material is provided for each of said compartments or receptacles.

5. A training harness in accordance with claim 4 wherein said compartments or receptacles are pockets sewn on an outer perimeter side of the waist member.

6. A training harness in accordance with claim 1 wherein at least one compartment or receptacle is formed integrally with each of the leg encircling portions; and at least one thin sheet of a heavy material is provided that can be removably received in each of the compartments or receptacles associated with each of the leg encircling portions.

7. A training harness in accordance with claim 6 wherein at least two compartments or receptacles are formed integrally with each of said leg encircling portions, and at least one thin sheet of heavy material is provided for each of the compartments or receptacles associated with said leg encircling portions.

8. A training harness in accordance with claim 7 wherein the compartments or receptacles associated with each of said leg encircling portions are pockets sewn on an outer perimeter side of the respective leg encircling portions.

9. A training harness in accordance with claim 1 wherein a plurality of compartments or receptacles are formed integrally with each of the leg encircling portions;

the compartments or receptacles associated with each of said leg encircling portions are spaced generally uniformly along the length of the respective leg encircling portion, and at least one thin sheet of heavy material is provided for each of the compartments or receptacles associated with each of said leg encircling portions.

10. A training harness in accordance with claim 9 wherein the compartments or receptacles associated with each of said leg encircling portions are pockets sewn on an outer perimeter side of the respective leg encircling portions.

* * * * *